US008596097B2

(12) United States Patent
Kim et al.

(10) Patent No.: US 8,596,097 B2
(45) Date of Patent: Dec. 3, 2013

(54) WASHING MACHINE

(75) Inventors: Myung Shik Kim, Gyeongsangnam-do (KR); Ho Il Jeon, Gyeongsangnam-do (KR); Jong Hee Han, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 1064 days.

(21) Appl. No.: 12/501,871

(22) Filed: Jul. 13, 2009

(65) Prior Publication Data

US 2010/0005839 A1 Jan. 14, 2010

(30) Foreign Application Priority Data

Jul. 14, 2008 (KR) ..... 10-2008-0067961

(51) Int. Cl.
*D06F 39/12* (2006.01)

(52) U.S. Cl.
USPC ..... 68/3 R; 68/13 R; 68/4; 312/228; 312/265.5; 312/265.6; 312/204

(58) Field of Classification Search
USPC ..... 68/3 R, 4, 13 R; 312/228, 265.5–265.6, 312/204, 401, 405
See application file for complete search history.

(56) References Cited

U.S. PATENT DOCUMENTS 2,842,420 A * 7/1958 Hansen et al. ..... 312/348.6
5,908,227 A * 6/1999 Wilhelmstatter et al. ..... 312/204
7,735,346 B2 * 6/2010 Ha et al. ..... 68/196
7,934,399 B2 * 5/2011 No et al. ..... 68/3 R
8,062,433 B2 * 11/2011 Yoo ..... 134/57 D
8,104,312 B2 1/2012 Hur
2002/0129750 A1 9/2002 Nelson et al.
2007/0169520 A1 * 7/2007 Heo ..... 68/3 R
2007/0186594 A1 * 8/2007 Kim et al. ..... 68/12.01
2008/0203870 A1 * 8/2008 Riley et al. ..... 312/265.6
2008/0256984 A1 * 10/2008 Lim et al. ..... 68/12.23

FOREIGN PATENT DOCUMENTS

DE 10 2006 039 284 A1 4/2007
GB 2022621 A 12/1979
GB 2071706 A * 9/1981
JP 60174184 A * 9/1985
JP 03178694 A * 8/1991
KR 2006089083 A * 8/2006
KR 2007016881 A * 2/2007
WO WO 2006110006 A1 * 10/2006

* cited by examiner

*Primary Examiner* — Michael Barr
*Assistant Examiner* — Kevin G Lee
(74) *Attorney, Agent, or Firm* — Birch, Stewart, Kolasch & Birch, LLP

(57) ABSTRACT

A washing machine is disclosed. The washing machine includes a cabinet, a drum provided inside of the cabinet so as to accommodate laundry, a front panel provided with an opening for inputting laundry into the drum, an outer panel assembled to a front side of the cabinet and having the front panel fixed thereto, and a supplementary panel being fixed to the outer panel and being provided along an outer periphery of the front panel.

6 Claims, 2 Drawing Sheets

WASHING MACHINE

This application claims the benefit of the Korean Patent Application No. 10-2008-0067961, filed on Jul. 14, 2008, which is hereby incorporated by reference as if fully set forth herein.

BACKGROUND OF THE INVENTION

1. Field of the Invention

The present invention relates to a washing machine, and more particularly, to an assembly structure of a panel being attached to a front side of a cabinet, which forms the exterior of the washing machine.

2. Discussion of the Related Art

Generally a washing machine consists of a device for eliminating (or removing) foreign substances (e.g., dirt and stain) included in laundry through a chemical action of detergent and a mechanical action between a washing water and a washing tub, and a device for drying the washed laundry by provided heated air (or hot air) thereto. The above-described washing machine may be categorized into a front loading type and a top loading type based upon the method of inputting the laundry. More specifically, the front loading type washing machine refers to a washing machine wherein laundry is inputted through a front side of the cabinet, and the top loading type washing machine refers to a washing machine wherein laundry is inputted through a top side of the cabinet.

Since the washing machine is provided with various parts for the washing and drying functions, such as a drum, a motor, a heater assembly, a controller, and so on, within the inside of the cabinet, which forms the exterior of the washing machine, when external water flows into the cabinet, malfunction may occur in the above-described parts. This problem may not only cause a loss in reliability from the consumers (i.e., customers and users) but also cause deterioration in the durability of the washing machine. Therefore, blocking the inflow of external liquid into the cabinet is the most essential and crucial aspect in designing washing machines. Furthermore, taking into consideration the increasing demand from consumers for enhanced functions as well as more unique and trendy designs, the need for a technology that can resolve the technical problems of the conventional washing machines and also provide trendy external designs in washing machines is also rising.

SUMMARY OF THE INVENTION

Accordingly, the present invention is directed to a washing machine that substantially obviates one or more problems due to limitations and disadvantages of the related art.

An object of the present invention is to provide a washing machine that can prevent external liquid from flowing into the cabinet of the washing machine.

A further object of the present invention is to provide a washing machine having enhanced durability by preventing the inflow of external liquid into the cabinet of the washing machine.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a washing machine includes a cabinet forming an exterior of the washing machine and having a front side which is opened, a drum provided inside of the cabinet so as to accommodate laundry, an outer panel mounted to the front side of the cabinet, a front panel mounted to the outer panel and having an opening for inputting laundry into the drum, and a supplementary panel being provided between the outer panel and an outer periphery of the front panel.

In this case, the cabinet may include a rib bent inwardly from an outer periphery of the front side. Also, the outer panel may include an extension having a front surface to contact with the front panel and a rear surface to contact with the rib.

Furthermore, the front panel may include an assembly element assembled to the rib. Also, the extension may include a hole through which the assembly element can penetrate. And, the rib may include an assembly hole for joining the assembly element.

Additionally, the supplementary panel may be forcibly fixed in a gap between the outer panel and an outer periphery of the front panel, thereby being assembled.

Additionally, protrusions may be provided on inner and outer periphery of the supplementary panel, so as to forcibly fix the supplementary panel. Herein, each of the outer panel and the front panel may include a curved part accommodating the protrusions in positions corresponding to the protrusions.

The supplementary panel may be chrome-plated. Herein, the front panel may have a color different from that of the outer panel and that of the supplementary panel. Also, the supplementary panel may have a color different from those of the front panel and that of the outer panel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
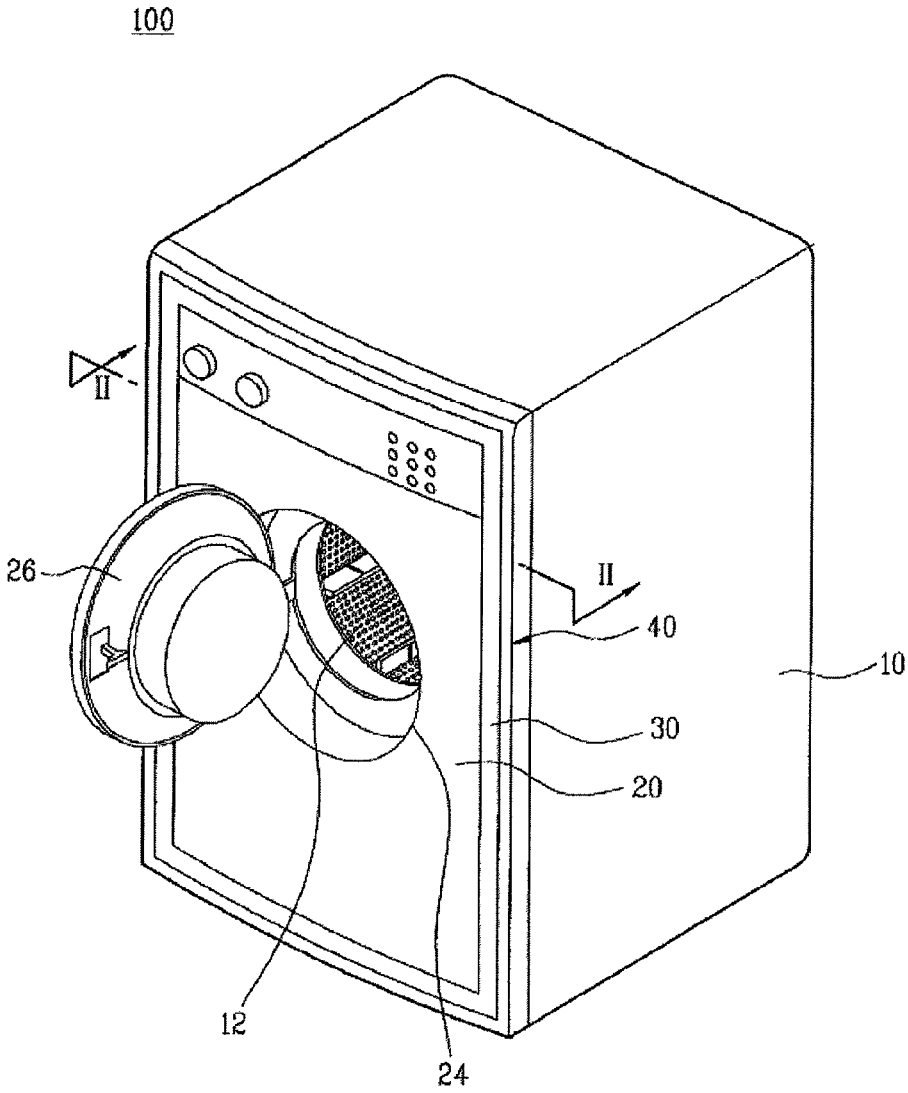
FIG. 1 illustrates a perspective view of a washing machine according to an embodiment of the present invention.

Reference will now be made in detail to the preferred embodiments of the present invention, examples of which are illustrated in the accompanying drawings. Wherever possible, the same reference numbers will be used throughout the drawings to refer to the same or like parts.

In the description of the present invention, a washing machine collectively refers to a washer for washing, rinsing, and spin-drying laundry and a dryer drying damp (or wet) laundry.

The structure of the washing machine will now be described in detail with reference to FIG. 1. According to the embodiment of the present invention, the washing machine 100 includes a cabinet 10 and a drum 12. Herein, the cabinet 10 forms the exterior of the washing machine, and the drum 12 is rotatably fixed inside of the cabinet 10. The drum 12 accomodates the laundry. And, although it is not shown in the drawing, according to the embodiment of the present invention, the inside of the drum 12 may also be provided with a tub (not shown) for accommodating the washing water that is rotatably fixed.

Meanwhile, the front side of the cabinet 10 is open so as to be assembled with a front panel 20. The front panel 20 may include an opening 24 for inputting laundry into the drum 12. The front panel 20 may also be fixed to an outer panel 40, thereby being assembled with the front side of the cabinet 10. The front panel 20 may include an assembly element for being assembled with the cabinet 10. However, the assembly element will be described in detail in a later process.

Furthermore, the opening 24 may include a door 26, which the user may open and close. Therefore, by opening the door 26, the user may input the laundry into the drum 12. One side of the outer panel 40 contacts with an outer periphery of the cabinet 10, and the other side of the outer panel 40 contacts to an outer periphery of the front panel 20. More specifically, the front panel 20 may be mounted to the front side of the cabinet 10 while having the outer panel 40 placed between the front panel 20 and the cabinet 10.

Meanwhile, when the front panel 20 is mounnted to the outer panel 40, a gap may be formed between the outer panel 40 and a periphery of the front panel 20. This gap may act as a space for allowing external water or foreign substance to flow into the cabinet 10. Therefore, the washing machine according to the present invention may further include a supplementary panel 30 that can be forcibly fixed in the gap between the outer panel 40 and the periphery of the front panel 20.

Figure 2:
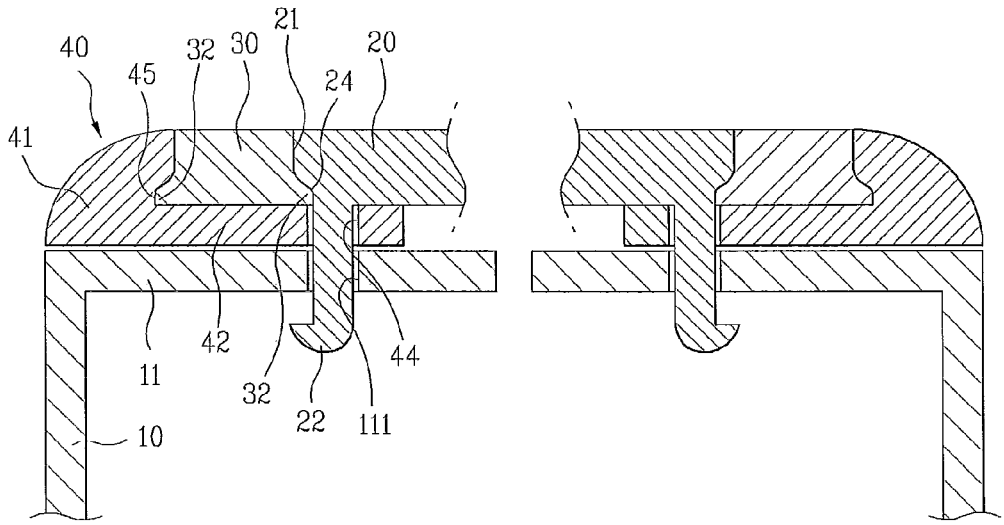
FIG. 2 illustrates a cross-sectional view taken along line II-II of FIG. 1.

FIG. 2 illustrates a cross-sectional view taken along line II-II of FIG. 1. Hereinafter, the assembled structure of the outer panel 40, the front panel 20, the supplementary panel 30, and the cabinet 10 will now be described in detail with reference to FIG. 2.

The cabinet 10 includes a rib 11 bent inwardly from an outer periphery of the front side. The rib 11 can fix an assembly element 22 of the front panel 20 thereto. The rib 11 may be provided on the overall outer periphery of the cabinet 10. However, the rib 11 may also be provided only at a position corresponding to the assembly element 22 of the front panel 20.

Meanwhile, it is preferable that the rib 11 further includes an assembly hole 111 for joining the assembly element 22. The front side of the rib 11 contacts with a rear surface of the outer panel 40. The outer panel 40 may include a body 41 and an extension 42, which extends from the body 41. A front surface of the extension 42 contacts with a portion of the outer periphery of the front panel and a rear surface of the extension contacts with the rib. The extension 42 also includes a hole 44 through which the assembly element 22 of the front panel can penetrate. Accordingly, when the front panel 20 is mounted to the extension 42, the assembly element 22 passes through the hole 44 so as to protrude towards the rib 11, thereby being joined with the assembly hole 111.

Meanwhile, the assembly element 22 may be provided in the form of a hook, and the assembly hole 111 of the rib 11 may be provided in a form corresponding to the hook-form of the assembly element 22. When the front panel 20 is assembled with the outer panel 40 by using the above-described assembly parts, water from an external source may flow into the cabinet through a gap (or space) formed between the outer periphery 21 of the front panel 20 and the outer panel 40. Furthermore, when assembled as described above, it would be difficult to implement a design distinguished from the related art washing machines.

Therefore, in order to be provided with a more enhanced and trendy design, the washing machine according to the present invention may further include a supplementary panel 30 between the outer panel 40 and the outer periphery 21 of the front panel 20. The supplementary panel 30 is inserted in a gap (or space) formed between the body 41 of the outer panel 40 and the outer periphery 21 of the front panel 20, thereby forming the front side (or surface) of the cabinet 10.

In this case, the supplementary panel 30 may be fixed by using a separate assembly element. However, it is preferable that the supplementary panel 30 is forcibly fixed in the space between the outer panel 40 and the front panel 20. This structure may facilitate the assembly of the supplementary panel 30, thereby reducing the assembly time. Furthermore, when assembling the supplementary panel 30 by using a separate assembly element, the inflow of a foreign substance into the cabinet 10 may be prevented by the separate assembly element inserted in the gap.

It is preferable that the outer panel 40 includes a curved part on a connection point between the body 41 and the extension 42. It is also preferable that the front panel 20 includes a curved part 24 on the portion of the outer periphery 21 adjacent to the assembly element 22. In this case, it is preferable that both ends of the supplementary panel 30 are respectively provided with protrusions 32 corresponding to the curved parts 45 and 24. Furthermore, it is also preferable that the space formed between the body 41 of the outer panel 40 and the outer periphery 21 of the front panel 20 is provided to have a width relatively narrower than the width of the supplementary panel 30.

Accordingly, after the supplementary panel 30 is forcibly fixed between the outer panel 40 and the front panel 20, the protrusions 32 are fastened to the curved parts 45 and 24, thereby maintaining the position of the supplementary panel 30. As a result, the supplementary panel 30 may be fixed to the front panel 20 and the outer panel 40 without requiring a separate assembly element. Thus, foreign substances may be prevented from flowing into the inside of the cabinet 10.

Meanwhile, the supplementary panel 30 may be formed of diverse materials. However, considering the design of the washing machine, it is preferable that the supplementary panel is formed of a material different from that used for forming the front panel 20 and the outer panel 40. For example, the supplementary panel 30 may be formed of a material processed with chrome plating. Since chrome plating can provide metallic luster to the supplementary panel 30, when the supplementary panel 30 is provided between the front panel 20 and the outer panel 40, the washing machine may be provided with a unique and trendy design.

Meanwhile, in order to provide a washing machine having a unique and trendy design, the front panel 20 may be provided in a color different from those of the outer panel 40 and the supplementary panel 30. Furthermore, the supplementary panel may also be provided in a color different from the color of the front panel 20 and the outer panel 40.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A washing machine, comprising:

a cabinet forming an exterior of the washing machine and having a front side which is opened;

a drum provided inside of the cabinet so as to accommodate laundry;

an outer panel mounted to the front side of the cabinet;

a front panel mounted to the outer panel and having an opening for inputting laundry into the drum; and a supplementary panel being provided between the outer panel and an outer periphery of the front panel, wherein the outer panel includes:

an extension contacting a rear surface of the front panel; and a body extending forward from the extension so that a space is formed between the body and an outer periphery of the front panel, wherein the supplementary panel is fixed between the outer panel and the front panel by being inserted into the space, wherein protrusions are provided on an inner periphery and an outer periphery of the supplementary panel, and wherein each of the outer panel and the front panel includes a curved part accommodating the protrusions in positions corresponding to the protrusions, so as to forcibly fix the supplementary panel to the outer panel and the front panel.

2. The washing machine of claim 1, wherein the cabinet includes a rib bent inwardly from an outer periphery of the front side, and wherein the outer panel includes an extension having a front surface to contact with the front panel and a rear surface to contact with the rib.

3. The washing machine of claim 2, wherein the front panel includes an assembly element assembled to the rib, wherein the extension includes a hole through which the assembly element can penetrate, and wherein the rib includes an assembly hole for joining the assembly element.

4. The washing machine of claim 1, wherein the supplementary panel is chrome-plated.

5. The washing machine of claim 1, wherein the front panel has a color different from that of the outer panel and that of the supplementary panel.

6. The washing machine of claim 1, wherein the supplementary panel has a color different from that of the front panel and that of the outer panel.

* * * * *